US010695682B1

(12) United States Patent
Trowbridge et al.

(10) Patent No.: US 10,695,682 B1
(45) Date of Patent: Jun. 30, 2020

(54) AUTOMATED DYNAMIC ADAPTIVE CONTROLS

(71) Applicant: Disney Enterprises, Inc., Burbank, CA (US)

(72) Inventors: Robert Scott Trowbridge, Burbank, CA (US); Asa K. Kalama, Burbank, CA (US); Robert E. Huebner, Burbank, CA (US)

(73) Assignee: DISNEY ENTERPRISES INC., Burbank, CA (US)

( * ) Notice: Subject to any disclaimer, the term of this patent is extended or adjusted under 35 U.S.C. 154(b) by 0 days.

(21) Appl. No.: 16/147,437

(22) Filed: Sep. 28, 2018

Related U.S. Application Data

(60) Provisional application No. 62/610,808, filed on Dec. 27, 2017.

(51) Int. Cl.
*A63G 31/02* (2006.01)
*A63G 31/16* (2006.01)

(52) U.S. Cl.
CPC ..... *A63G 31/02* (2013.01); *A63G 31/16* (2013.01)

(58) Field of Classification Search
CPC ..... A63G 31/16; A63G 31/15; A63G 25/00; A63B 31/02; G01C 21/365; G06Q 30/0269; G05B 1/01
USPC ..... 472/59
See application file for complete search history.

(56) References Cited

U.S. PATENT DOCUMENTS

| | | | | |
|---|---|---|---|---|
| 4,657,247 | A * | 4/1987 | Okada | A63F 13/00 463/23 |
| 7,555,147 | B2 | 6/2009 | Simmons | |
| 8,025,581 | B2 | 9/2011 | Bryan et al. | |
| 8,371,951 | B2 | 2/2013 | Nemeth et al. | |
| 8,469,823 | B2 * | 6/2013 | Roberts | A63F 13/00 463/47 |
| 8,764,530 | B2 * | 7/2014 | Matsui | A63F 13/10 463/1 |
| 8,856,061 | B2 | 10/2014 | Baughman et al. | |
| 9,433,866 | B2 * | 9/2016 | Jacob | A63F 13/10 |
| 9,443,144 | B2 | 9/2016 | Lucey et al. | |
| 9,463,379 | B1 | 10/2016 | Brister et al. | |
| 10,289,194 | B2 * | 5/2019 | McCracken | G06F 1/163 |
| 2008/0009332 | A1 * | 1/2008 | Kake | A63F 13/06 463/7 |
| 2013/0300644 | A1 | 11/2013 | Chen | |

(Continued)

*Primary Examiner* — Michael D Dennis
(74) *Attorney, Agent, or Firm* — Kilpatrick Townsend & Stockton LLP

(57) ABSTRACT

Systems and methods for automated dynamic adaptive control are disclosed herein. The system can include a simulation vehicle that can transit at least one participant through an entertainment experience from a starting positon to a terminating position. The simulation vehicle can include a plurality of user controls. The system can include a processor that can: provide content to the at least one participant; receive user inputs via the plurality of controls of the simulation vehicle. The processor can: affect the entertainment experience based on the received user inputs; identify an intervention based on a determined discrepancy between received user inputs and expected user inputs; and modify an effect of the user inputs on the entertainment experience according to the identified intervention.

19 Claims, 7 Drawing Sheets

(56) References Cited

U.S. PATENT DOCUMENTS

| | | | | |
|---|---|---|---|---|
| 2014/0128144 | A1* | 5/2014 | Bavitz | A63F 9/24 463/23 |
| 2016/0089610 | A1* | 3/2016 | Boyle | A63G 25/00 463/7 |
| 2016/0332084 | A1* | 11/2016 | McVeen | B61C 3/00 |
| 2016/0346704 | A1 | 12/2016 | Wagner | |

* cited by examiner

AUTOMATED DYNAMIC ADAPTIVE CONTROLS

CROSS-REFERENCES TO RELATED APPLICATIONS

This application claims the benefit of U.S. Provisional Application No. 62/610,808, filed on Dec. 27, 2017, and entitled "AUTOMATED DYNAMIC ADAPTIVE CONTROLS", the entirety of which is hereby incorporated by reference herein.

BACKGROUND

The present disclosure relates generally to management of a physical user input devices to an entertainment system such as a simulator, vehicle, amusement ride or the like. While such entertainment systems have historically been mechanically based, amusement rides increasingly integrate virtual or gaming-based aspects. The integration of virtual or gaming-based aspects improves the participant experience by enabling participant to affect all or portions of the experience.

The integration of user input into an entertainment system can have unintended results including, for example, when some user inputs cause changes that negatively affect other user's experience. This dependence upon user inputs can cause variation in ride-length, difficulty in achieving in-game goals, or disruption to the entertainment experience of other participants. Accordingly, further developments in amusement rides are desired.

BRIEF SUMMARY

One aspect of the present disclosure relates to a system for automated dynamic adaptive control. The system includes: a simulation vehicle that can transit at least one participant through an entertainment experience from a starting positon to a terminating position, the simulation vehicle including a plurality of user controls; and a processor. The processor can: provide content to the at least one participant; receive user inputs via the plurality of controls of the simulation vehicle; affect the entertainment experience based on the received user inputs; identify an intervention based on a determined discrepancy between received user inputs and expected user inputs; and modify an effect of the user inputs on the entertainment experience according to the identified intervention.

In some embodiments, the determined discrepancy between the received user inputs and expected user inputs is based on an absence of inputs. In some embodiments, the determined discrepancy between the received user inputs and expected user inputs is based on excessive inputs. In some embodiments, the processor can determine a discrepancy between the received user inputs and the expected user inputs. In some embodiments, the discrepancy between the received user inputs and the expected user inputs indicates for reconfiguration of the user controls.

In some embodiments, modifying the effect of the user inputs on the entertainment experience according to the identified intervention includes reconfiguring of the user controls. In some embodiments, the discrepancy between the received user inputs and the expected user inputs indicates for filtering of the received user inputs. In some embodiments, the discrepancy between the received user inputs and the expected user inputs indicates for decoupling of the user controls from the ride experience.

In some embodiments, modifying the effect of the user inputs on the entertainment experience according to the identified intervention includes at least one of: applying a filter to received user inputs to mitigate the effect of the user inputs of the ride experience; decoupling the user controls from the ride experience; or force feedback. In some embodiments, the identified intervention is dynamic. In some embodiments, the processor can: initiate dynamic tracking of the dynamic intervention; and modify the dynamic intervention as a parameter relevant to the user inputs changes over time. In some embodiments, the parameter can be at least one of: an elapsed time; a diminished discrepancy between received user inputs and expected user inputs; or a receipt of a user input.

One aspect of the present disclosure relates to a method for automated dynamic adaptive control. The method includes: providing content as a part of an entertainment experience to at least one participant of a simulation vehicle, the simulation vehicle including a plurality of user controls; receiving user inputs via the plurality of user controls of the simulation vehicle; affecting the entertainment experience based on the received user inputs; identifying an intervention based on a determined discrepancy between received user inputs and expected user inputs; and modifying an effect of the user inputs on the entertainment experience according to the identified intervention.

In some embodiments, the determined discrepancy between the received user inputs and expected user inputs is based on at least one of: an absence of inputs; ineffective inputs, unsatisfactory inputs, or excessive inputs. In some embodiments, the method includes determining a discrepancy between the received user inputs and the expected user inputs, In some embodiments, the discrepancy between the received user inputs and the expected user inputs indicates for reconfiguration of the user controls.

In some embodiments, modifying the effect of the user inputs on the entertainment experience according to the identified intervention includes reconfiguring of the user controls. In some embodiments, the discrepancy between the received user inputs and the expected user inputs indicates for filtering of the received user inputs. In some embodiments, the discrepancy between the received user inputs and the expected user inputs indicates for decoupling of the user controls from the ride experience.

In some embodiments, modifying the effect of the user inputs on the entertainment experience according to the identified intervention includes at least one of: applying a filter to received user inputs to mitigate the effect of the user inputs of the ride experience; decoupling the user controls from the ride experience; or force feedback. In some embodiments, the identified intervention is dynamic. In some embodiments, the method includes: initiating dynamic tracking of the dynamic intervention; and modifying the dynamic intervention as a parameter relevant to the user inputs changes over time. In some embodiments, the parameter can be at least one of: an elapsed time; a diminished discrepancy between received user inputs and expected user inputs; or a receipt of a user input.

DETAILED DESCRIPTION

Figure 1:
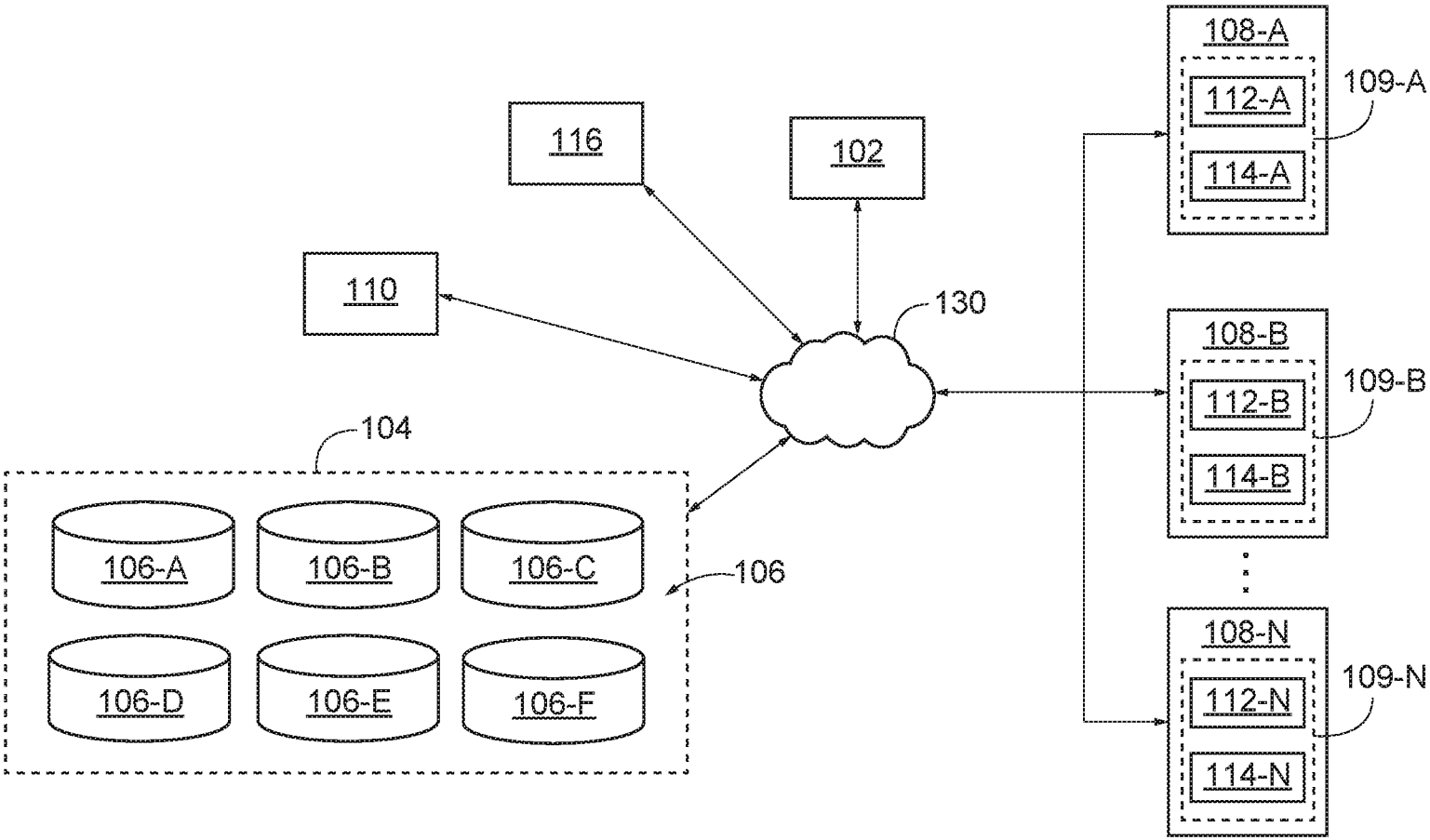
FIG. 1 is a schematic illustration of one embodiment of a system for automated dynamic adaptive control.

The ensuing description provides illustrative embodiment(s) only and is not intended to limit the scope, applicability or configuration of the disclosure. Rather, the ensuing description of the illustrative embodiment(s) will provide those skilled in the art with an enabling description for implementing a preferred exemplary embodiment. It is understood that various changes can be made in the function and arrangement of elements without departing from the spirit and scope as set forth in the appended claims.

I. Introduction

Developing technologies in simulation present many opportunities for future creation of physical entertainment experiences that provide a unique and customized experience for participants. This customization and uniqueness can arise through the merging of traditional amusement rides with video gaming and simulation technologies to create hybrid entertainment experiences that incorporate aspects of both traditional amusement rides and gaming/simulation. These hybrid entertainment experiences can include aspects that only exist in the real world and aspects that only exist in the virtual world. Further, these hybrid rides can include aspects that exist in the virtual world such as, for example, a virtual conveyance in which the participants ride through the virtual world which has a corresponding physical counterpart in the form of a simulation vehicle. Hybrid systems can have physical input devices such as knobs, switches, buttons, sliders and the like that enhance the participant's experience by providing a tangible interaction with perceivable effects that can be experienced in the simulation. The implementation of tangible input with perceivable effect is an important aspect of creating an enjoyable interactive experience for guests. While such hybrid experiences can create more interactive experiences than previously possible with traditional amusement rides, these hybrid rides present new challenges.

In contrast to played-at-home video games, an entertainment experience implemented in a public venue is an event of finite duration and significant amounts of time cannot be used in training a participant to properly interact with the entertainment systems. Hence, it is desirable that the user input devices and their effect are intuitive, but it has also been found that the experience is improved when the use of and perceivable effect of the input devices can dynamically and intelligently adapt to participants' idiosyncrasies Further, a single simulation vehicle may contain multiple participants, some or all of which participants may be responsible for interaction with user controls of the simulation vehicle to affect the experience. In the event that a participant is unable to interact or properly interact with the user controls or in the event that the participant provides non-meaningful or spurious user inputs, the experience of the other participants may be negatively impacted.

To address these limitations, an entertainment system can include features or capabilities to receive user inputs through tangible interface devices and determine whether to provide an intervention based on these received user inputs. Determining whether to provide the intervention can be based on, for example, a comparison of any received user inputs to data representing a range of expected user inputs. The comparison may be performed continuously, periodically, or at key points in the experience to meet the needs of a particular application. Moreover, the comparison may be based on single user input events, or patterns of input events from a single use or multiple users. This comparison can, for example, result in the identification of a user failing to provide any user inputs or in identification of a user providing spurious or non-meaningful inputs. In some embodiments, for example, the comparison of the received user inputs and the expected user inputs can result in the generation of data, such as a delta value, characterizing or representing the difference between the received user inputs and the expected user inputs. Based on, for example, the magnitude of this data and/or a comparison of some or all of this data to one or several thresholds, an intervention can be indicated.

The intervention can be, in some embodiments, indicated based at least in part based on the data generated character or representing the difference between the received user inputs and the expected user inputs. In some embodiments, for example, this data can indicate a lack of user inputs and the intervention can comprise providing prompts to the user to encourage user inputs, the activating or increasing of "auto-pilot" for all or portions of the entertainment experience, and/or the intervention can comprise the transferring of control of aspects of the entertainment experience to another participant via, for example, deactivation and/or reactivation of some of the user controls of the participant vehicle. In some embodiments, the data can indicate meaningful user inputs combined with spurious user inputs. In such an embodiment, the intervention can comprise the application of filtering to the received user inputs to filter the spurious user inputs and maintain the meaningful user inputs. In some embodiments, the data can indicate wholly non-meaning and/or spurious user inputs. In such embodiments, the intervention can include providing prompts to encourage desired user inputs, providing force feedback, disabling user controls, and/or reassigning user controls (e.g., changing the in-game response caused by one control to occur when activated by an alternate control).

The entertainment system can include capabilities for automatic determination and implementation of a control configuration. In some embodiments, this can include receiving a control configuration from a user device, such as, for example, from a wearable computer, smartcard, a cell phone, smart phone, or tablet or other available method to explicitly or implicitly recognize a participant and retrieve configuration information. In some embodiments, the automatic determination and implementation of a control configuration can include the intuiting of a control configuration. This intuiting can be accomplished via the providing of configuration events to the user, the receiving of user inputs in response to the configuration events, and identifying a configuration profile based on the received user inputs or the received user inputs and the configuration events. Once the configuration profile has been identified, the entertainment system can interpret received user inputs according to the configuration profile.

II. Simulation System

FIG. 1 is a schematic illustration of one embodiment of an entertainment system 100. The system 100 can include a processor 102. The processor 102 can be any computing and/or processing device including, for example, one or several laptops, personal computers, tablets, smartphones, servers, mainframe computers, processors, or the like. The processor 102 can be configured to receive inputs from one or several other components of the system 100, to process the inputs according to one or several stored instructions, and to provide outputs to control the operation of one or several of the other components of the system 100.

In some embodiments, the processor 100 can implement a game engine that can include a rendering engine. The game engine and the rendering engine can together, or independently develop and/or progress the narrative of the simulation and/or the generate images as well as trigger lighting, special effects, audio effects and the like corresponding to that narrative. In some embodiments, the rendering engine can generate one or several events that can be, in part, based upon user inputs provided to the system 100. These events can include, for example, one or several accelerations, decelerations, changes in direction, interaction with one or several objects or characters, or the like.

In some embodiments, the processor 100 can include a motion control. The motion control can control motion of a simulation vehicle 108 via control of a motion base 110 that is connected to the simulation vehicle and/or upon which or on which the simulation vehicle is mounted. The motion control can control motion of the simulation vehicle according to one or several inputs received from the user and/or one or several game events.

The system 100 can include memory 104. The memory 104 can represent one or more storage media and/or memories for storing data, including read only memory (ROM), random access memory (RAM), magnetic RAM, core memory, magnetic disk storage mediums, optical storage mediums, flash memory devices and/or other machine readable mediums for storing information. The term "machine-readable medium" includes, but is not limited to portable or fixed storage devices, optical storage devices, and/or various other storage mediums capable of storing that contain or carry instruction(s) and/or data. The memory 104 can be an integral part of the processor 102 and/or can be separate from the processor 102. In embodiments in which the memory 104 is separate from the processor 102, the memory 104 and the processor 102 can be communicatingly linked via, for example, communications network 130. In some embodiments, the communications network 130 can comprise any wired or wireless communication connection between the components of the simulation system 100.

The memory 104 can include software code and/or instructions for directing the operation of the processor 102 and/or can include one or several databases 106 containing information used by the processor 102 and/or generated by the processor 102.

The memory 104 can include a narrative/imagery database 106-A. The narrative/imagery database 106-A stores narrative and image data. This narrative and image data can include information and/or data relating to the narrative and the imagery generated as part of the narrative. Specifically, the narrative and image data is data and information that is used to generate the narrative and the imagery and/or sound in the narrative. This can include identification of one or several: objects; characters; effects; or things existing within the narrative, and data or databases defining these one or several: objects; characters; effects; or things. This data or databases defining the one or several: objects; characters; effects; or things can identify attributes of the one or several objects, characters, effects, or things, which attributes can define a size, a speed, sound, movement characteristics, illumination characteristics, or the like. The narrative database 106-A can further include information regarding events in the narrative and the sequencing of those events.

The memory 104 can include a simulation vehicle database 106-B. The simulation vehicle and/or actuator system database 106-B can include data relating to the simulation vehicle and/or the actuator system. In some embodiments, this database 106-B can include information relating to features of the simulation vehicle and/or relating to the control of the simulation vehicle and/or the interaction with user control features located on the simulation vehicle. In some embodiments, for example, the simulation vehicle can move in response to user inputs to the user control features and/or according to the narrative of the simulation or to events in the narrative of the simulation. The simulation vehicle database 106-B can include data identifying one or several features of the simulation vehicle that enable the movement of the simulation vehicle. These features can include, for example, one or several motors, servo motors, pneumatic or hydraulic components, or the like.

The memory 104 can include a profile database 106-C. The profile database 106-C can include information identifying one or several configuration profiles. In some embodiments, the configuration profile can include information identifying a skill level of a participant of an amusement ride, and/or a value characterizing a discrepancy between inputs received from the participant and expected inputs. In some embodiments, each of these configuration profiles can include information identifying a configuration of some or all of the user controls. This configuration can identify a desired response inside of the entertainment experience to a received user input. In some embodiments, for example, a configuration profile can specify that pulling back on a control stick can cause the virtual conveyance to climb and pushing forward on the control stick can cause the virtual conveyance to dive. In another configuration, for example, a configuration profile can specify that pulling back on a control stick can cause the virtual conveyance to dive and pushing forward on the control stick can cause the virtual conveyance to climb.

The configurations stored in the profile database 106-C can be temporarily stored or permanently stored. In some embodiments, for example, a participant can create a configuration profile and/or can associate with a configuration profile before riding on the amusement ride. This creation of the configuration profile or association with a participant profile can be performed via a user accessing a website via a computing device including, for example, a laptop, a personal computer, a telephone, a smartphone, a tablet, or the like. In some embodiments, a configuration created by a participant can be stored until the participant has completed the amusement ride, or similarly, an association between a participant and a configuration profile can be stored until the participant has completed the amusement ride.

The memory 104 can include an input database 106-D can include information for evaluating inputs received via the controls of the simulation vehicle. These inputs can be participant inputs, also referred to herein as user inputs. In some embodiments, these inputs can be received in response to one or several events in the entertainment experience of the amusement ride and these inputs can direct the control of all or portions of the virtual conveyance and/or the interaction of the participant with the virtual world of the amusement ride. In some embodiments, this information can include expected input data. The expected input data can characterize or identify expected user inputs to one or several events within the virtual world of the amusement ride. These expected user inputs can, for example, characterize an expected manner in which the user would control the virtual conveyance in response to one or several events in the amusement ride.

The memory 104 can include a trigger database 106-E. The trigger database 106-E can include information identifying one or several thresholds. These one or several thresholds can be used in triggering one or several intervention(s). In some embodiments, for example, one or several of these thresholds can delineate between acceptable and unacceptable user inputs based on a comparison of actual, received user inputs with the expected input data. In some embodiments, the trigger database 106-E can include one or several thresholds for determining when to terminate an intervention.

The memory 104 can include an intervention database 106-F. The intervention database 106-F can include information identifying and comprising one or several interventions. These interventions can, in some embodiments, be provided to a participant in response to user inputs and can include, for example, one or several prompts to encourage desired participant inputs, applying a filter to received user inputs to mitigate the effect of the user inputs of the ride experience; deactivating user controls, decoupling the user controls from the ride experience, reassigning user controls, and/or force feedback. In some embodiments, the intervention database 106-F can further include information for determine if and/or how an intervention is terminated.

In some embodiments, for example, the strength of an intervention may decay over time, thus, in some embodiments, the level of filtering may decrease over time. In some embodiments, a filter may terminate when a desired user skill level is reached and/or when user inputs adequately approximate the desired user inputs.

The system 100 can include one or several simulation vehicles 108 including, for example, a first simulation vehicle 108-A, a second simulation vehicle 108-B, and up to and including an $N^{th}$ simulation vehicle 108-N. The simulation vehicle 108 can provide hardware corresponding to some or all of the features of the virtual conveyance in which the participant is located in the gaming/simulation portion of the ride experience. The simulation vehicle 108 can transport participants from a starting position to a termination positon, which starting position can be the location at which participants enter the simulation vehicle 108 and which termination position can be the location at which the participants exit the simulation vehicle 108. In some embodiments, the starting position and the termination position can be co-located.

The simulation vehicle 108 can contain one or several participants in, for example, a seat, a restraint system, or the like. The simulation vehicle 108 and/or the components thereof can be communicatingly connected with the processor 102. This communication connection can allow the providing of information to the simulation vehicle 108, which information can control operation of all or portions of the simulation vehicle 108, and which communicating connection can allow the receipt of information from the simulation vehicle 108 by the server 102, which information can include one or several user inputs at the simulation vehicle 108. The simulation vehicle 108 can be movable according to the narrative and/or according to one or several events in the narrative to, in combination with generated imagery, create the sensation of movement for the participants. In some embodiments, each of the simulation vehicles 108 can be mounted to, on, and/or upon a motion base 110, also referred to herein as the actuator system. The motion base 110 can move the simulation vehicle 108 that is mounted to, on, and/or upon the motion base 110. The motion base 110 can include one or several: motors; servo motors; pneumatic components; hydraulic components; or the like.

The simulation vehicle 108 can include controls 109 that can include a display system 112 and an input system 114. The display system 112 can provide information to the one or several participants of the simulation vehicle 108 and the input system 114 can receive information from the one or several participants of the simulation vehicle 108. In some embodiments, each simulation vehicle 108 can include the display system 112 and the input system 114 such that, for example, the first simulation vehicle 108-A can include the first display system 112-A and the first input system 114-A, the second simulation vehicle 108-B can include the second display system 112-B and the second input system 114-B, up to the $N^{th}$ simulation vehicle 108-N which can include the $N^{th}$ display system 112-N and the $N^{th}$ input system 114-N.

The display system 112 can include features to provide information to the users such as, for example, one or several displays, screens, monitors, speakers, or the like, and can include features with which the user can provide input to the simulation vehicle 108. In some embodiments, the input system 114 can include, for example, one or several: wheels; levers; buttons; control sticks; pedals; switches; slides; and knobs. In some embodiments, the simulation vehicle 108 can move and/or be configured to move according to control signals received from the processor 102 and/or the user control features.

The system 100 can include an image generator 116, also referred to herein as a simulation display. The image generator 116 can be communicatingly connected with the processor 102 and can comprise one or several features configured to generate images according to one or several control signals received from the processor 102. The image generator 116 can comprise one or several screens, displays, monitors, projectors, illuminators, lasers, or the like. In some embodiments, the image generator 116 can further include one or several speakers or other features configured to generate sound. In some, the one or several screens, displays, monitors, projectors, illuminators, speakers, and/or lasers forming the image generator 116 can be connected to the simulation vehicle such that they move with the movements of the simulation vehicle 108, or the one or several screens, displays, monitors, projectors, illuminators, and/or lasers forming the image generator 116 can be separated from the simulation vehicle 108. In some embodiments, the one or several screens, displays, monitors, projectors, illuminators, and/or lasers forming the image generator 116 can be wholly or partially: flat; curved; domed; arched; and/or angled. The generated images can be viewable by the participant from the simulation vehicle 108.

Figure 2:
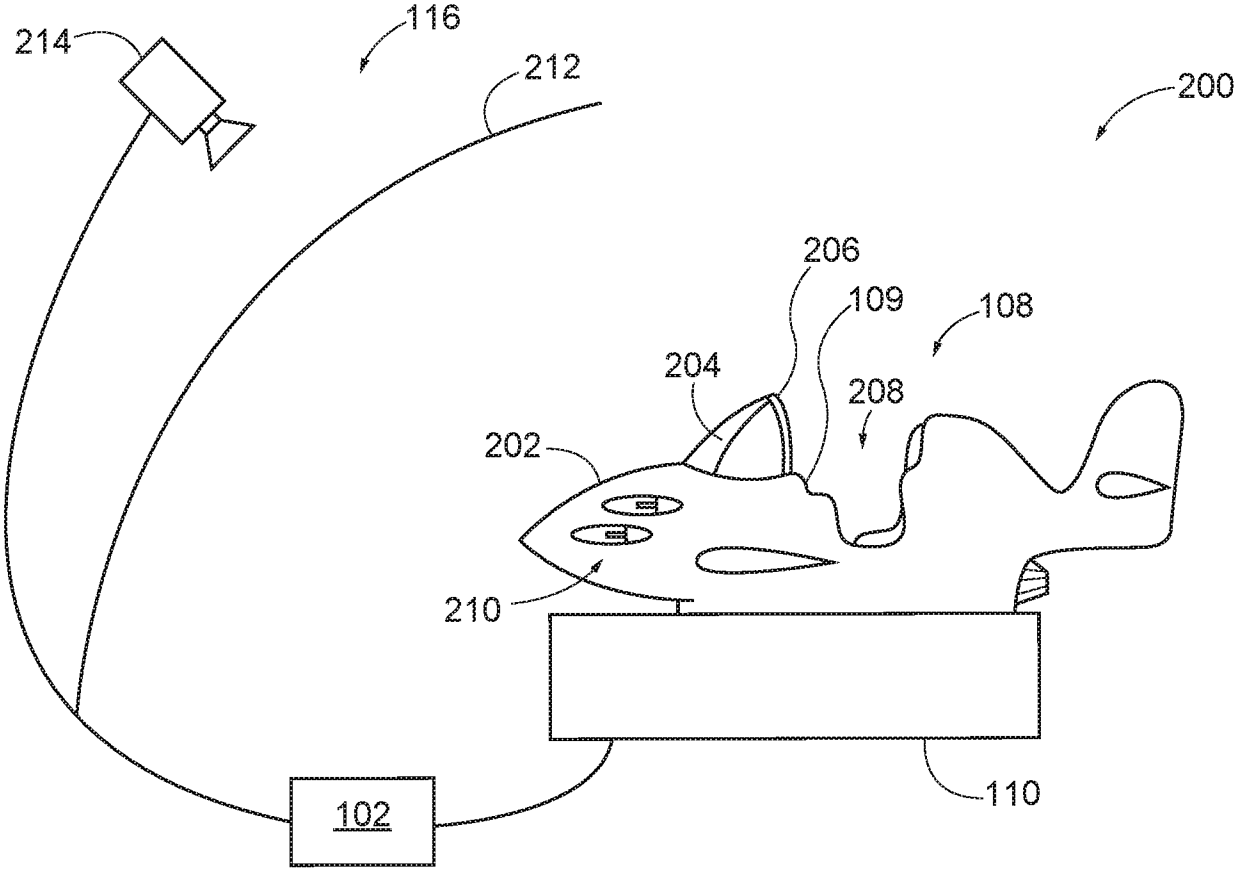
FIG. 2 is a schematic illustration of one embodiment of a system including simulation vehicles.

FIG. 2 is a schematic illustration of a simulation environment 200. The simulation environment 200 can include all or portions of the system 100. Specifically, as seen in FIG. 2, the simulation environment 200 includes the simulation vehicle 108, the motion base 110, and the user controls 109. The simulation vehicle 108 shown in FIG. 2, further includes a body 202 including windows 204 and opaque structural features 206 such as, for example, a roof, pillars, posts, and/or window frames or framing. The simulation vehicle 108 can further include a participant area 208 that can include one or several seats, restraints, or the like, and one or several accessory features 210 which can be, for example, one or several simulated weapons such as a simulated firearm, a simulated laser, a simulated missile, a simulated bomb, or the like.

The simulation environment 200 can include the image generator 116. The image generator 116 can include a screen 212 and at least one projector 214. The screen 212 can comprise a variety of shapes and sizes and can be made from a variety of materials. In some embodiments, the screen 212 can be flat, and in some embodiments, the screen 212 can be angled, curved, domed, or the like. In some embodiments, the screen 212 is curved and/or domed to extend around all or portions of the simulation vehicle 108, and specifically is curved and/or domed to extend around portions of the simulation vehicle 108 so that a participant looking out of the simulation vehicle 108 sees the screen.

One or several projectors 214 can project images onto the screen 212. These projectors 214 can be located on the same side of the screen 212 as the simulation vehicle 108 or on the opposite side of the screen 212 as the simulation vehicle. The projectors 214 can be controlled by the processor 102.

III. Simulation Vehicle

Figure 3:
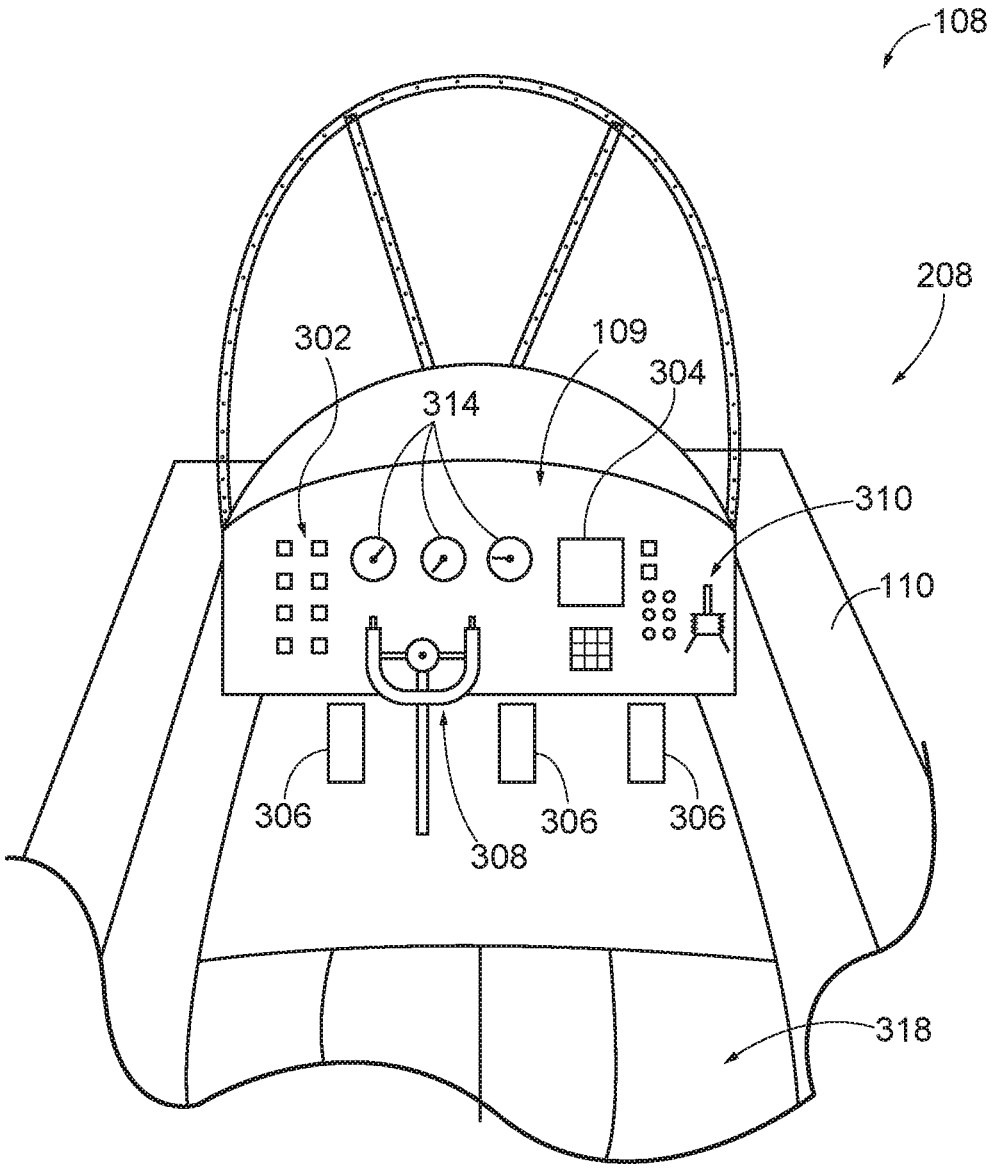
FIG. 3 is an illustration of one embodiment of a participant area of a simulation vehicle.

FIG. 3 show an illustration of one embodiment of the participant area 208 of the simulation vehicle 108. The simulation vehicle 108 is mounted on the motion base 110 and the simulation vehicle 108 includes controls 109 including the display system features 112 and the input system features 114. The display system features 112 can include, for example, one or several: displays 304, including screens, monitors, touchscreens, or the like; one or several gauges 314, or the like. The input system features 114 can include one or several: buttons 302; pedals 306; steering wheels 308; control sticks 310; or the like. As further seen in FIG. 3, the simulation vehicle 108 can include accommodations 318 which can include a seat, one or several participant restraints, or the like.

IV. Automated Dynamic Adaptive Control

Figure 4:
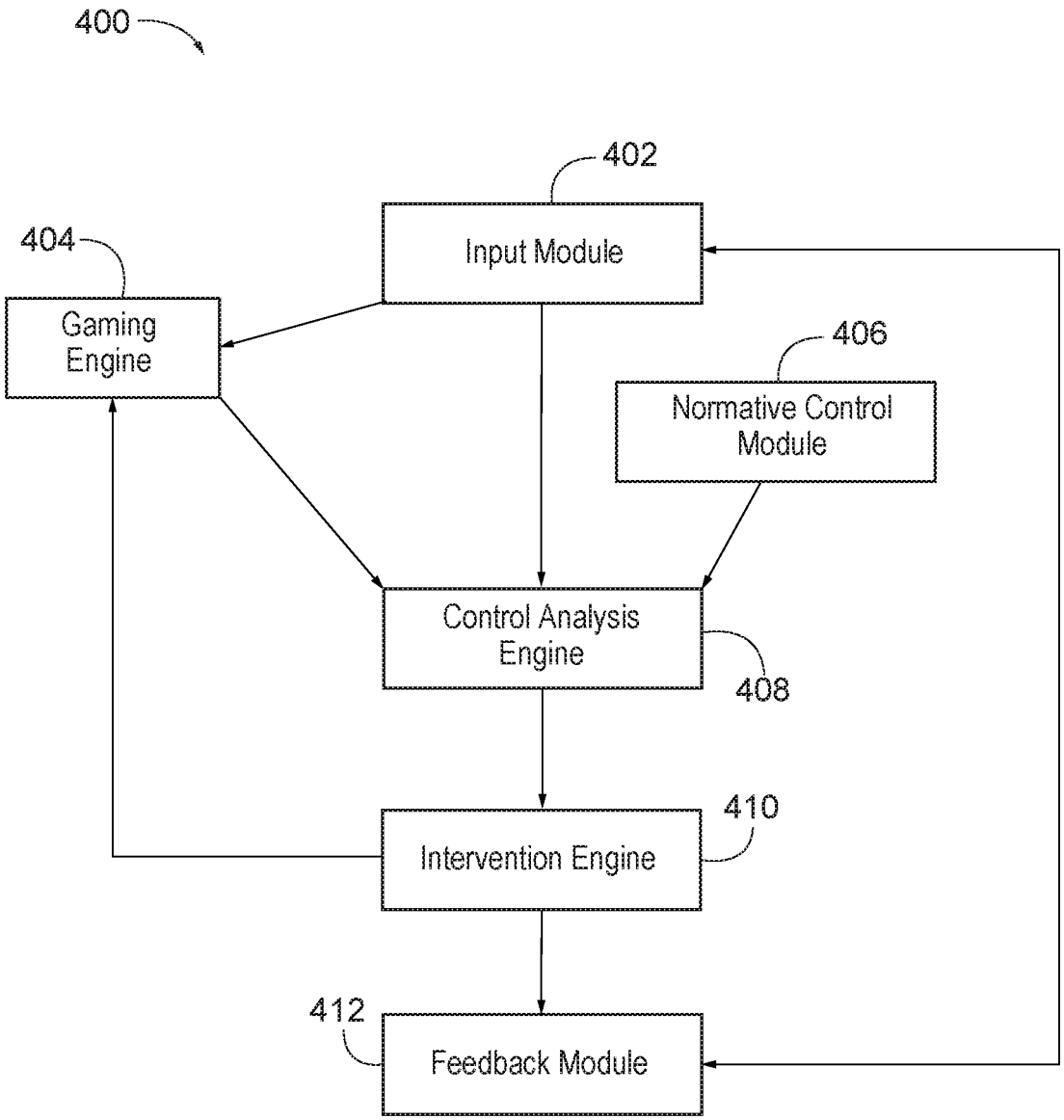
FIG. 4 is a functional block-diagram of modules that can provide for automated dynamic adaptive control.

FIG. 4 is a functional block-diagram of modules 400 for providing automated dynamic adaptive control. These modules 400 can be hardware modules and/or software modules. In some embodiments, these modules can be wholly or partially located on the processor 102. The modules 400 include an input module 402. The input module 402 can communicate with the controls 109 of the simulation vehicle 108 to receive electrical signals corresponding to user inputs provided via the controls. The input module 402 can output information relating to the user inputs to the gaming engine 404, to the control analysis engine 408, and to the feedback module 412.

The gaming engine 404 can control the generation and/or presentation of the narrative of the entertainment experience to a participant of the simulation vehicle 108. This can include the identification of game events which can include an acceleration, a deceleration, a change in direction of travel, a collision with an object, an explosion, or the like. The generation and/or presentation of the narrative of the entertainment experience can include generation of signals to control the image generator 116 to generate imagery and/or sound corresponding to one or several events in the narrative of the ride experience. In some embodiments, based on the received user inputs, the gaming engine can identify a response of the virtual conveyance to the user inputs and/or the direct or indirect effects of the user inputs on the virtual conveyance. In some embodiments, and by way of example, a direct effect includes when a user input indicates a turn of the virtual conveyance, and an indirect effect includes when a user inputs causes the explosion of an object within the gaming/simulation portion of the ride experience, which explosion creates shock-waves buffeting the virtual conveyance. The gaming engine can further track the participant's and/or simulation vehicle's 108 progression through the ride experience. The gaming engine 404 can output information to the control analysis engine 408.

The normative control module 406 can receive expected input data from the input database 106-D and can provide this expected input data to the control analysis engine 408. The control analysis engine 408 can receive inputs from the input module corresponding to received user inputs, also referred to herein as participant inputs, can receive expected input data from the normative control module 406, and can receive information relating to progression through the entertainment experience and/or ride events from the gaming engine 404. In some embodiments, for example, the control analysis engine 408 can receive information identifying progress through the entertainment experience from the gaming engine 404, and can, based on this information, request expected input data, also referred to herein as normative control data, from the normative control module 406. The control analysis engine 408 can, receive the expected input data from the normative control module 406 and actual participant inputs from the input module 402 and can compare the actual participant inputs to the expected user inputs. In some embodiments can identify if user inputs were received and if any received user inputs matched expected inputs. In some embodiments, the control analysis engine 408 can identify a discrepancy between expected inputs and actual inputs, which discrepancy can be characterized by a delta value.

The control analysis engine 408 can provide an output to the intervention engine 410, and specifically can provide data characterizing the discrepancy between expected inputs and actual inputs to the intervention engine 410. The intervention engine can, determine if an intervention is indicated by comparing the discrepancy to a threshold delineating between instances in which an intervention is indicated and instances in which an intervention is not indicated. This threshold can be retrieved from the trigger database 106-E.

If an intervention is indicated, the intervention can select and implement the intervention. In some embodiments, for example, one or more of one or several interventions may be applicable to a participant in a ride experience. In some embodiments, for example, a first intervention may be indicated if no user inputs are received, which first intervention can include providing one or several prompts to encourage user inputs, activation of an autopilot, the reconfiguration of user controls, and/or transferring of control to another participant. Likewise, a second intervention may be indicated if meaningful user inputs are obscured by noise such as, for example, when a user with a tremor interacts with the user controls. This second intervention can comprise application of a filter to the user inputs to separate the meaningful user inputs from the noise, and/or force feedback. A third intervention may be indicated if user inputs are non-meaningful such as when a toddler or young child interacts with the controls. In such an instance, the intervention can include one or several prompts encouraging desired user inputs, force feedback, a partial or complete decoupling of the controls to the virtual conveyance such that the user inputs have a minimal effect on the virtual conveyance, activation of an autopilot, a transfer of controls, and/or a deactivation of controls.

In some embodiments, the implanting of the intervention can include modification of the intervention over time. In some embodiments, for example, the strength of the intervention may decay as time passes since the triggering of the intervention. In some embodiments, the intervention may be weakened and/or deactivated if the user demonstrates increased skill and/or as the discrepancy between the expected inputs and the received inputs decreases.

In some embodiments, and as depicted in FIG. 4, the intervention engine 410 can output to the gaming engine 404 and/or to the feedback module 412. In some embodiments, the intervention can comprise force feedback which can provide physical resistance to movement of the controls. In some embodiments, this can amount to filtration of user inputs by increasing the difficulty with which those inputs are provided. Force feedback can be provided through the use or any desired number of mechanical, hydraulic, pneumatic, electro-mechanical, magnetic, or other techniques. In some embodiments, the force feedback can be controlled by the interaction of the feedback module 412 and the input engine 402.

Figure 5:
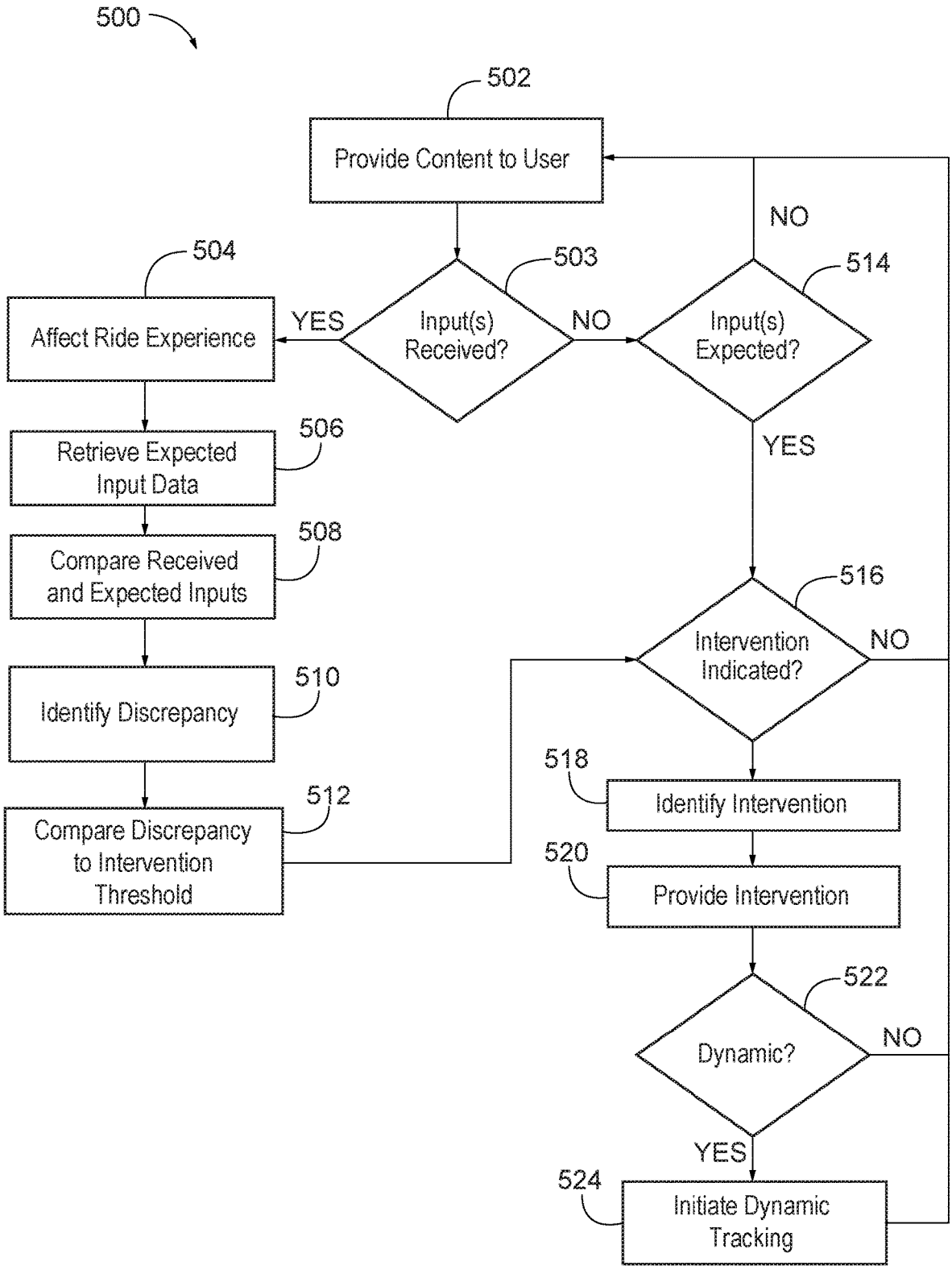
FIG. 5 is a flowchart illustrating one embodiment of a process for automated dynamic adaptive control.

FIG. 5 shows a flowchart illustrating one embodiment of a process 500 for automated dynamic adaptive control. The process 500 can be performed by the modules 400 of FIG. 4 and/or by the processor 102. The process 500 begins at bock 502, wherein content is provided to the participant of the simulation vehicle. In some embodiments, this content can be provided as part of the entertainment experience after the participant has entered the simulation vehicle and after the simulation vehicle has begun to transit the participant, which can be at least one participant through the ride experience. In some embodiments, the content can be provided to the participant via the display system 112 and/or the image generator 116.

After, or while the content is being provided to the user, the process 500 proceeds to decision block 503, wherein it is determined if inputs are received. In some embodiments, this can include determining if inputs have been received by processor 102 from the control 109 of the simulation vehicle 108. If inputs are received, then the process 500 proceeds to block 504, wherein the entertainment experience is affected according to the inputs. In some embodiments, this can correspond to the providing of inputs from the input module 402 to the gaming engine 404, which gaming engine 404 can turn affect the entertainment experience including the motion and/or action of the virtual according to the received inputs.

At block 508 of the process 500, expected input data is received and/or retrieved. In some embodiments, the expected input data can be received by the processor 102 from the memory 104, and specifically from the input database 106-D. The receipt of the expected input data can correspond to the normative control module 406 providing the expected input data to the control analysis engine 408. In some embodiments, the receipt and/or retrieving of the expected input data can include identifying a location within the entertainment experience and/or identifying current events or actions in the ride experience, requesting expected input data from the normative control module 406 based on this location within the ride experience, and receiving the expected input data from the normative control module 406.

At block 508 of the process 500, the received inputs are compared to the expected input data. This comparison can be performed by the processor 102 and specifically by the control analysis engine 408 which can be a module, either hardware or software, within the processor 102. In some embodiments, the comparison of the received inputs with the expected input data can result in the identification of a discrepancy, as indicated in block 510, between the received inputs and the expected input data, which discrepancy can be characterized by one or several values such as, for example, a delta value. This discrepancy can be stored in the memory 104, and specifically can be stored in the In some embodiments, the comparison of the received input data and the expected input data can further result in a classification of the received inputs. This can include, for example, classifying of the received inputs as non-meaningful, classifying the received inputs as meaningful and obscured via, for example, user generated noise in the inputs, classifying the received inputs as non-meaningful and obscured, classifying the received inputs as meaningful and excessive, and/or classifying the received inputs as meaningful and inadequate. In some embodiments, for example, a user input may be meaningful and excessive or alternatively may be meaningful and inadequate when the user inputs correspond to a direction of expected user input but are of the wrong magnitude—e.g. it is expected for the user to turn the virtual conveyance, but the user input either turns the virtual conveyance too much or too little. In some embodiments, this classification can be performed based on the discrepancy between the expected input data and the received user inputs.

At block 512, the discrepancy identified in block 510 is compared to an intervention threshold. In some embodiments, this can include the retrieving of the intervention threshold, which can be one or several thresholds, from the trigger database 106-E. This intervention threshold can then be compared with the identified discrepancy to determine if an intervention is indicated. This comparison of the discrepancy and the intervention threshold can be performed by the processor 102, and specifically by the intervention engine 410.

Returning again to decision block 503, if it is determined that no input has been received, the process 500 proceeds to decision block 514, wherein it is determined if an input was expected. In some embodiments, the determination of decision block 514 can be made by the processor 102, and specifically by the control analysis engine 408 according to the user location in the entertainment experience and/or recent events in the entertainment experience and the expected input data. In some embodiments, the absence of a received participant input, when an input is expected as indicated in the expected input data, can give rise to a discrepancy with the expected input data. If it is determined that an input was not expected, then the process 500 returns to block 502 and proceeds as outlined above.

Alternatively, if it is determined that an input was expected, or returning again to block 512, after comparing the discrepancy to the intervention threshold, the process 500 proceeds to decision block 516, wherein it is determined if an intervention is indicated. In some embodiments, this determination can be based on the number of expected inputs that were not received, the duration of time in which inputs were expected and not received, and/or whether the discrepancy meets or exceeds the intervention threshold. This determination of whether an intervention is indicated can be performed by the processor 102 and specifically can be performed by the intervention engine 410.

If it is determined that an intervention is not indicated, then the process 500 returns to block 502 and proceeds as outlined above. If it is determined that an intervention is indicated, then the process 500 proceeds to block 518, wherein an intervention is identified. In some embodiments, this intervention can be identified for providing to the participant. The intervention can be identified and/or selected to match or correspond to the discrepancy between the received inputs and the expected inputs. In some embodiments, for example, the intervention can be selected to match the classification of the received inputs. Thus, in some embodiments, the discrepancy between the received user inputs and the expected user inputs can indicate for an intervention and/or a type of intervention. In some embodiments, the discrepancy can indicate for reconfiguration of the user controls, for filtering of the received user inputs, for decoupling of the user controls from the ride experience, and/or for force feedback. The identification of the intervention can be performed by the processor 102 and more specifically can be performed by the intervention engine 410.

At block 520, the intervention is provided. The intervention can be provided by the intervention engine 410, the gaming engine 404, and/or the feedback module 412. In some embodiments, the providing of the intervention can include, for example, providing one or several prompts to encourage desired participant inputs, applying a filter to received user inputs to mitigate the effect of the user inputs of the ride experience; deactivating user controls, decoupling the user controls from the ride experience, reassigning user controls, and/or force feedback. The providing of the intervention can affect the entertainment experience and/or modify an effect of participant inputs on the ride experience. In some embodiments, modifying the effect of the user inputs on the entertainment experience according to the identified intervention can include at least one of: applying a filter to received user inputs to mitigate the effect of the user inputs of the ride experience; decoupling the user controls from the ride experience; or force feedback At decision block 522, it is determined if the provided intervention is dynamic. In some embodiments, for example, the provided intervention can change as a parameter relevant to the participant to whom the intervention is provided changes, and in some embodiments, changes over time. This parameter can include, for example, the amount of time elapsed since the providing of the intervention increases, as user inputs are received, participant skill level increases, and/or as the discrepancy between the received inputs and the expected inputs decrease. In some embodiments, an intervention can be associated with information identifying the intervention as being dynamic or non-dynamic. In some embodiments, for example, each intervention can be associated with a value identifying the intervention as either dynamic or non-dynamic, which value can be stored in the intervention database 106-F. The determination of whether an intervention is dynamic can be performed by the processor 102 and specifically can be performed by the intervention engine 410.

If it is determined that the intervention is not dynamic, then the process 500 returns to block 502 and proceeds as outlined above. If it is determined that the intervention is dynamic, then the process 500 proceeds to block 524, wherein dynamic tracking is initiated by, for example, the processor 102 and/or the intervention engine 410. In some embodiments, the initiation of dynamic tracking can include triggering a timer to track elapsed time since the providing of the intervention, the tracking of a skill level of the participant to whom the intervention was provided, and/or the tracking of a change to the discrepancy between received inputs and expected inputs for the participant to whom the intervention was provided. In some embodiments, and as a part of the initiation of dynamic tracking, the intervention can be changed as the parameter associated with the participant to whom the intervention was provided changes. After the initiation of the dynamic tracking, or while the dynamic tracking is being performed, the process 500 can return to block 502 and continue as outlined above. In some embodiments, the process 500 can be performed until the entertainment experience is complete.

V. Automatic Control Configuration

Figure 6:
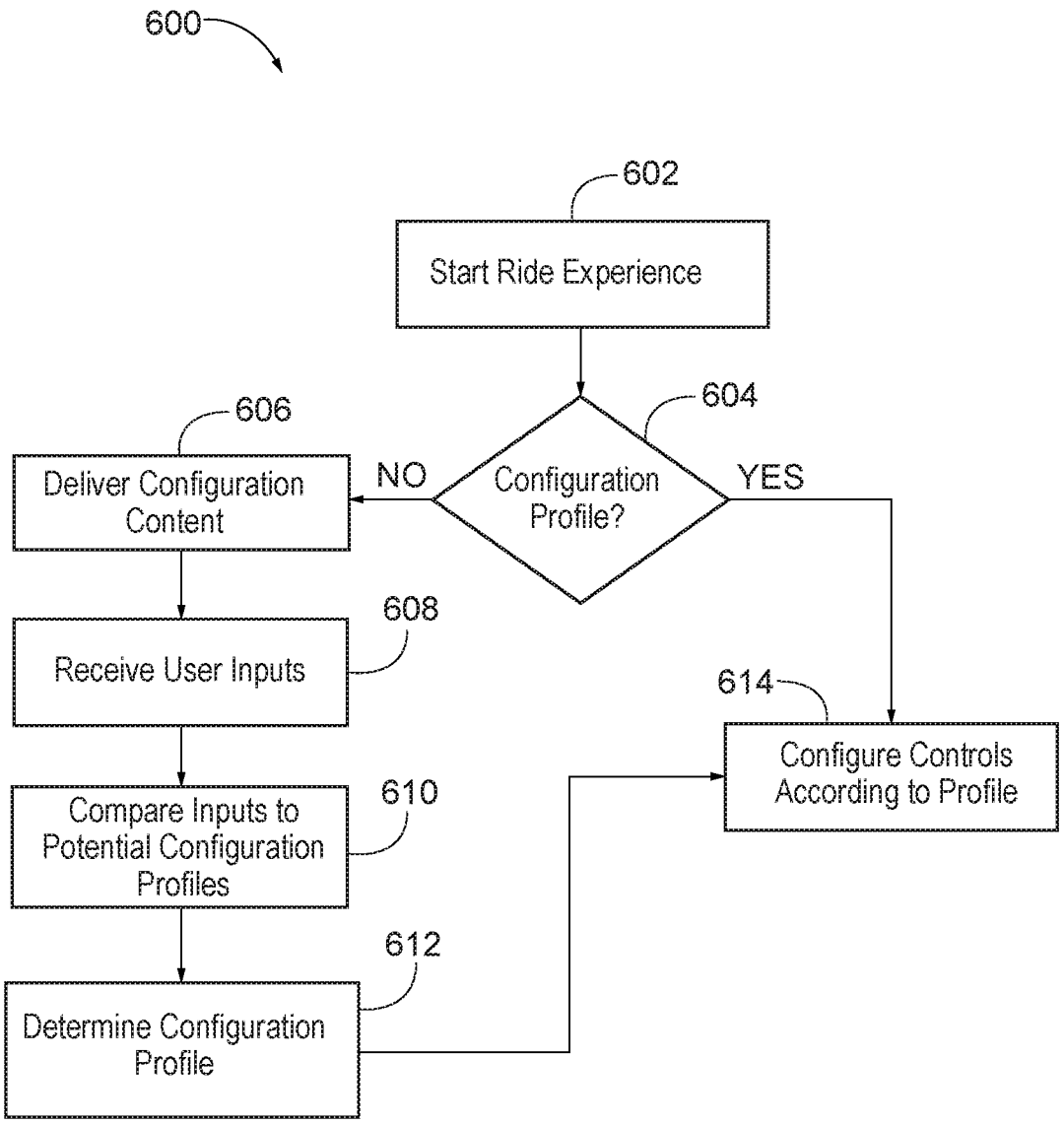
FIG. 6 is a flowchart illustrating one embodiment of a process for automatic control configuration.

FIG. 6 shows flow chart illustrating one embodiment of a process 600 for automatic control configuration. The process 600 can be performed by the processor 102, and in some embodiments, can be performed by the processor 102 at the start of the entertainment experience and/or immediately before the start of the ride experience. In some embodiments, for example, the system 100 can be configured to communicate with a participant device such as, for example a RFID enabled device, a telephone, a smart phone, and/or a tablet to receive a configuration profile, which communication can take place, for example, before the participant boards the simulation vehicle 108, as the participant boards the simulation vehicle 108, after the participant board the simulation vehicle 108, and/or before or after the simulation vehicle 108 embarks on transiting the participant.

At block 602, wherein the entertainment experience is started. This can include the communication with the participant device, before, during, or after the participant has entered the simulation vehicle 108 and/or communication with the participant device before or after the simulation vehicle 108 embarking on transiting the participant. In some embodiments, the start of the entertainment experience can include the beginning of presenting of content to the participant via, for example, the display system 112 and/or the image generator 116. At decision state 604, it is determined whether a specific configuration profile is selected for the participant, and specifically whether a non-default configuration profile is selected for the participant. In some embodiments, this can include determining whether a configuration profile is available from a participant device and/or if a configuration profile has been previously stored for the participant.

If a configuration profile is not available or selected, then the process 600 proceeds to block 606, wherein configuration content is delivered. In some embodiments, the configuration content can comprise content for which specific user inputs are expected, from which user inputs a configuration profile can be generated. In some embodiments, the content can comprise events necessitating the diving, climbing, and/or turning of the virtual conveyance. In some embodiments, the content can comprise prompts for the participant to provide an input to cause the virtual conveyance to climb, dive, and/or turn. The configuration content can be delivered by the processor via the gaming engine 404, the display system 112, and/or the image generator 116. At block 608, one or several user inputs are received in response to the provided configuration content. In some embodiments, the user inputs can be received via the controls 109 of the simulation vehicle 108 and can be provided to the processor 102 and/or the input module 402.

At block 610 of the process 600, the received inputs are compared to one or several potential configuration profiles. In some embodiments, for example in which the participant controls the virtual conveyance to climb and dive, the received participant inputs can be compared to a first profile in which the virtual conveyance is caused to climb by pulling back on a control stick and wherein the virtual conveyance is caused to dive by pushing forward on the control stick and the received participant inputs can be compared to a second profile in which the virtual conveyance is caused to dive by pulling back on the control stick and is caused to climb by pushing forward on the control stick. This comparison can be performed by the processor 102 and specifically by the control analysis engine 408.

At block 612 of the process 600, a configuration profile is determined and/or selected. In some embodiments, this configuration profile can be selected such that the received user inputs, when passed through the selected configuration profile, match or most closely match the inputs expected in response to the configuration content. The configuration profile can be determined and/or selected by the processor 102, and specifically by the control analysis engine 404.

After the configuration profile has been determined, or returning again to decision block 604, if it is determined that there is configuration profile selected for the participant, then the process 600 proceeds to block 614, wherein the controls are configured according to the configuration profile. In some embodiments, this can include providing the selected configuration profile to the input module 402. In some embodiments, the configuration profile can be associated with the participant until the participant has completed the ride experience.

VI. Computer System

Figure 7:
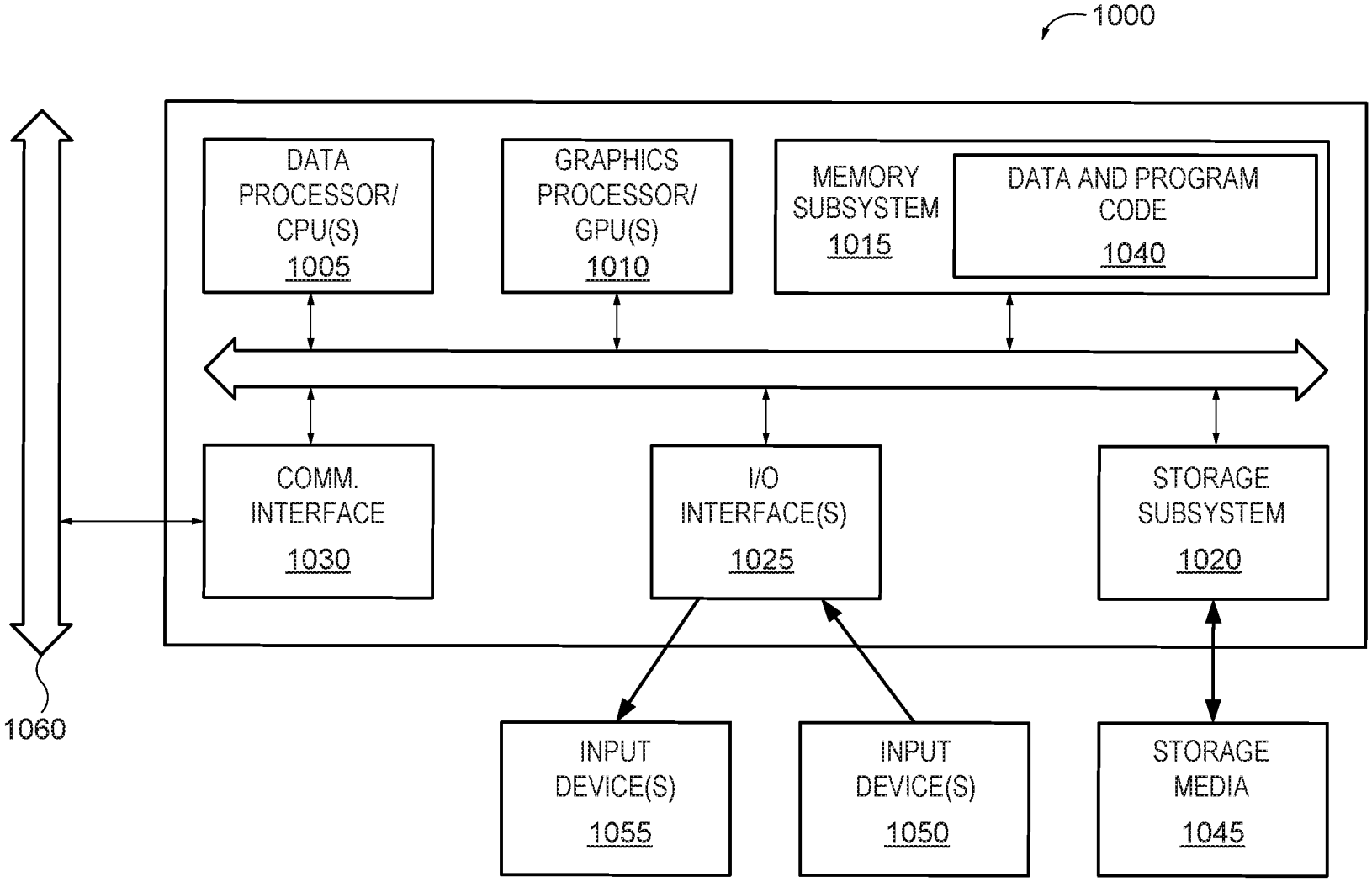
FIG. 7 is a block diagram of a computer system or information processing device that may incorporate an embodiment, be incorporated into an embodiment, or be used to practice any of the innovations, embodiments, and/or examples found within this disclosure.

FIG. 7 shows a block diagram of computer system 1000 that is an exemplary embodiment of the processor 102 and can be used to implement methods and processes disclosed herein. FIG. 7 is merely illustrative. Computer system 1000 may include familiar computer components, such as one or more one or more data processors or central processing units (CPUs) 1005, one or more graphics processors or graphical processing units (GPUs) 1010, memory subsystem 1015, storage subsystem 1020, one or more input/output (I/O) interfaces 1025, communications interface 1030, or the like. Computer system 1000 can include system bus 1035 interconnecting the above components and providing functionality, such connectivity and inter-device communication.

The one or more data processors or central processing units (CPUs) 1005 execute program code to implement the processes described herein. The one or more graphics processor or graphical processing units (GPUs) 1010 execute logic or program code associated with graphics or for providing graphics-specific functionality. Memory subsystem 1015 can store information, e.g., using machine-readable articles, information storage devices, or computer-readable storage media. Storage subsystem 1020 can also store information using machine-readable articles, information storage devices, or computer-readable storage media. Storage subsystem 1020 may store information using storage media 1045 that can be any desired storage media.

The one or more input/output (I/O) interfaces 1025 can perform I/O operations and the one or more output devices 1055 can output information to one or more destinations for computer system 1000. One or more input devices 1050 and/or one or more output devices 1055 may be communicatively coupled to the one or more I/O interfaces 1025. The one or more input devices 1050 can receive information from one or more sources for computer system 1000. The one or more output devices 1055 may allow a user of computer system 1000 to view objects, icons, text, user interface widgets, or other user interface elements.

Communications interface 1030 can perform communications operations, including sending and receiving data. Communications interface 1030 may be coupled to communications network/external bus 1060, such as a computer network, a USB hub, or the like. A computer system can include a plurality of the same components or subsystems, e.g., connected together by communications interface 1030 or by an internal interface.

Computer system 1000 may also include one or more applications (e.g., software components or functions) to be executed by a processor to execute, perform, or otherwise implement techniques disclosed herein. These applications may be embodied as data and program code 1040. Such applications may also be encoded and transmitted using carrier signals adapted for transmission via wired, optical, and/or wireless networks conforming to a variety of protocols, including the Internet.

The above description of exemplary embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated.

What is claimed is:

1. A system for automated dynamic adaptive control, the system comprising:

a simulation vehicle configured to transit at least one participant through an entertainment experience, the simulation vehicle comprising a plurality of user controls; and a processor configured to:

provide content to the at least one participant;

receive user inputs via the plurality of controls of the simulation vehicle;

affect the entertainment experience based on the received user inputs;

compare the received user inputs to expected user inputs;

determine a discrepancy between the received user inputs and the expected user inputs, wherein the discrepancy identifies a combination of meaningful user inputs and spurious user inputs in the received user inputs;

identify an intervention based on the determined discrepancy between the received user inputs and the expected user inputs, wherein the intervention comprises a filter configured to eliminate spurious user inputs while maintain meaningful user inputs; and modify an effect of the user inputs on the entertainment experience via application of the identified intervention.

2. The system of claim 1, wherein the determined discrepancy between the received user inputs and expected user inputs is based on an absence of inputs.

3. The system of claim 1, wherein the determined discrepancy between the received user inputs and expected user inputs is based on excessive inputs.

4. The system of claim 1, wherein the discrepancy between the received user inputs and the expected user inputs indicates for reconfiguration of the user controls.

5. The system of claim 4, wherein modifying the effect of the user inputs on the entertainment experience according to the identified intervention comprises reconfiguring of the user controls.

6. The system of claim 1, wherein the discrepancy between the received user inputs and the expected user inputs indicates for decoupling of the user controls from the entertainment experience.

7. The system of claim 1, wherein modifying the effect of the user inputs on the entertainment experience according to the identified intervention comprises at least one of: applying the filter to received user inputs to mitigate the effect of the user inputs of the entertainment experience; decoupling the user controls from the entertainment experience; or force feedback.

8. The system of claim 7, wherein the identified intervention is dynamic.

9. The system of claim 8, wherein the processor is further configured to: initiate dynamic tracking of the dynamic intervention; and modify the dynamic intervention as a parameter relevant to the user inputs changes over time.

10. The system of claim 9, wherein the parameter comprises at least one of: an elapsed time; a diminished discrepancy between received user inputs and expected user inputs; or a receipt of a user input.

11. A method for automated dynamic adaptive control, the method comprising:

providing content as a part of an entertainment experience to at least one participant of a simulation vehicle, the simulation vehicle comprising a plurality of user controls;

receiving user inputs via the plurality of user controls of the simulation vehicle;

affecting the entertainment experience based on the received user inputs;

identifying an intervention based on a determined discrepancy between received user inputs and expected user inputs, wherein identifying an intervention comprises identifying a configuration profile modifying a directional effect of the user inputs on the entertainment experience and corresponding to the received user inputs; and modifying an effect of the user inputs on the entertainment experience via application of the identified intervention, wherein modifying the effect of the user inputs on the entertainment experience according to the identified intervention comprises reconfiguring of the user controls according to the identified configuration profile.

12. The method of claim 11, wherein the determined discrepancy between the received user inputs and expected user inputs is based on at least one of: an absence of inputs; ineffective inputs, unsatisfactory inputs, or excessive inputs.

13. The method of claim 11, further comprising determining a discrepancy between the received user inputs and the expected user inputs.

14. The method of claim 13, wherein modifying the effect of the user inputs on the entertainment experience according to the identified intervention comprises at least one of: applying a filter to received user inputs to mitigate the effect of the user inputs of the entertainment experience; decoupling the user controls from the entertainment experience; or force feedback.

15. The method of claim 14, wherein the identified intervention is dynamic.

16. The method of claim 15, further comprising: initiating dynamic tracking of the dynamic intervention; and modifying the dynamic intervention as a parameter relevant to the user inputs changes over time.

17. The method of claim 16, wherein the parameter comprises at least one of: an elapsed time; a diminished discrepancy between received user inputs and expected user inputs; or a receipt of a user input.

18. The method of claim 13, wherein the discrepancy between the received user inputs and the expected user inputs indicates for filtering of the received user inputs.

19. The method of claim 13, wherein the discrepancy between the received user inputs and the expected user inputs indicates for decoupling of the user controls from the entertainment experience.

* * * * *